US005744006A

United States Patent [19]

Mausser et al.

[11] Patent Number: 5,744,006

[45] Date of Patent: *Apr. 28, 1998

[54] APPARATUS FOR DEWATERING MIXTURES OF FIBROUS AND LIQUID MATERIALS

[76] Inventors: Wilhelm Mausser, Berliner Ring 61 A-8047, Graz, Australia; Karlheinz Beil, deceased, late of Graz, Australia; Ilse Beil, Strasserhofwel 13 A-8045, Graz, Australia, Legal Representative of said Karlheinz Beil

[ * ] Notice: The terminal 12 months of this patent has been disclaimed.

[21] Appl. No.: 250,021

[22] Filed: May 27, 1994

[30] Foreign Application Priority Data

May 28, 1993 [AU] Australia ..... A 1045/93

[51] Int. Cl.[6] ..... D21F 3/06

[52] U.S. Cl. ..... 162/358.1; 162/272; 162/273; 162/360.2; 100/153; 100/176

[58] Field of Search ..... 162/272, 273, 162/274, 358.1, 358.3, 360.2, 360.3; 100/153, 176

[56] References Cited

U.S. PATENT DOCUMENTS 3,331,734 7/1967 Rojecki ..... 162/358.1
5,399,242 3/1995 Schiel ..... 162/358.1

*Primary Examiner*—Peter Chin
*Attorney, Agent, or Firm*—Chilton, Alix & Van Kirk

[57] ABSTRACT

The present invention relates to an apparatus for dewatering mixtures of fibrous and liquid materials wherein at least one pair of mutually opposite pressure elements forms a pressure gap through which a continuous web formed of the mixture of fibrous and liquid materials is passed jointly with at least one endless belt and wherein the pressure elements are set up in a press frame, at least one pressure element being movable in such frame, there being provided at least one distance adjustment means for adjusting at least one pressure element and thereby the magnitude of the pressure gap or the pressure intensity. The invention is characterized in that at least one distance adjustment means (17) is installed solely between the mountings (4,15; 5,16) of the pressure elements (2,3).

37 Claims, 5 Drawing Sheets

APPARATUS FOR DEWATERING MIXTURES OF FIBROUS AND LIQUID MATERIALS

BACKGROUND OF THE INVENTION

The invention relates to an apparatus for dewatering mixtures of fibrous and liquid materials wherein at least one pair of mutually opposite pressure elements forms a pressure gap through which a continuous web formed of the mixture of fibrous and liquid materials is passed jointly with at least one endless belt.

Conventionally, the pressure elements are set up in a press frame, with at least one pressure element being movable in such frame. At least one distance adjustment means is provided for adjusting at least one pressure element and thereby the magnitude of the pressure gap or the pressure intensity.

In such apparatus there exists a problem of controlling the application of forces into the pressure frame or the press stand structure. Particularly in the case of high pressure presses this results in large and heavy frame or stand components. Accordingly, proposals have already been made for solving this problem. Austrian patent specification 395 185 describes a system wherein the press frame forms an integrated unit and wherein the forces are so introduced into the press frame that the lines of force follow a closed pattern. German published specification 32 42 721 describes an apparatus which in addition proposes special tensile elements between the upper and the lower parts of the press roller stand. However, if high pressures are applied in machines of so-called cantilever type, i.e., machines comprising endless belts which when being installed or replaced have to be inserted or withdrawn, as the case may be, sideways into or from the machine, large forces arise in the releasable connecting members required therefor. The result is that either screws of exceptionally large dimensions and therefore of very high cost are needed to transfer the reaction forces arising from the pressing force (as for example in the apparatus according to Austrian patent specification 395 1 85) or special tensile elements which are thus likewise of expensive design (such as for example in the construction according to German published specification 32 42 721).

SUMMARY OF THE INVENTION

The invention has as an object to overcome this drawback in apparatus of the aforementioned type.

The present invention is characterized in that at least one distance adjustment means is installed solely between the mountings of the pressure elements. This offers the major advantage that as a result no forces whatsoever need to be applied to the press frame or the press stand. Accordingly, the aforementioned releasable connecting members are likewise not exposed to the reaction forces of the applied pressure and may accordingly be manufactured small and at reasonable cost. It is also possible to install a plurality of distance adjustment means between the mountings of the press elements respectively to provide the press elements in the form of pressure rollers.

An advantageous embodiment of the invention is characterized in that hydraulic cylinders are provided as distance adjustment means. The use of hydraulic cylinders permits the generation of extreme compressive forces.

In accordance with an advantageous further development of the inventive concept there is provided at least one hydraulic cylinder each on both the idling as well as the driven side.

If, in accordance with a further advantageous embodiment of the invention, two hydraulic cylinders each are employed both on the idling side as well as the driven side it is possible on the one hand to distribute the forces uniformly (symmetrically in respect of the roller axis) and on the other hand to avoid possible misalignment of the rollers.

A preferred embodiment of the invention is characterized in that the hydraulic cylinders jointly with the bearing mounting of a pressure element, taking the form of a pressure roller, are interconnected in an articulated manner, in particular by means of suitable connecting members. Due to the articulated mounting a misalignment of the rollers is likewise prevented. By virtue of the interconnection means being of simple design, this can also be easily released for purposes of replacing the belt.

A particularly advantageous modification of the invention results if the hydraulic cylinders are connected in fixed relationship to the bearing housings of a pressure element in the form of a pressure roller. This permits the generation in the pressure gap of high pressure forces in a simple manner, without the roller axes needing to be extended and/or strengthened. Accordingly, a conventional bearing construction can be employed.

A further advantageous embodiment of the invention is characterized in that the distance adjustment means, in particular hydraulic cylinders, are connected to a means for regulating and/or controlling the pressure forces. Such regulation and/or control permits a uniform pressure application of the rollers both longitudinally in respect of the machine (direction of travel of the web), as well as transversely to the web, i.e., uniformly both on the idling as well as the driven side. Pressure release of the press is also possible in a simple manner.

If at least one press unit according to the invention is integrated with the stand of a double screen press, such stand can be made of very simple design, because apart from the inherent weight of the press unit(s) itself no other forces need to be accommodated. It thus becomes possible to equip even very wide machines with relatively small and light stand designs.

A particularly advantageous solution according to the invention is afforded if the one or more distance adjustment means are connected directly to the mountings of the pressure elements in particular to the bearing housings of the pressure elements taking the form of pressure rollers. In appropriate circumstances this may permit a substantial simplification of the apparatus or construction.

The pressure elements may also take the form of pressure plates.

BRIEF DESCRIPTION OF THE DRAWINGS

The invention will be described below by way of example with reference to the accompanying drawings, in which.

DESCRIPTION OF THE PREFERRED EMBODIMENT

Figure 1:
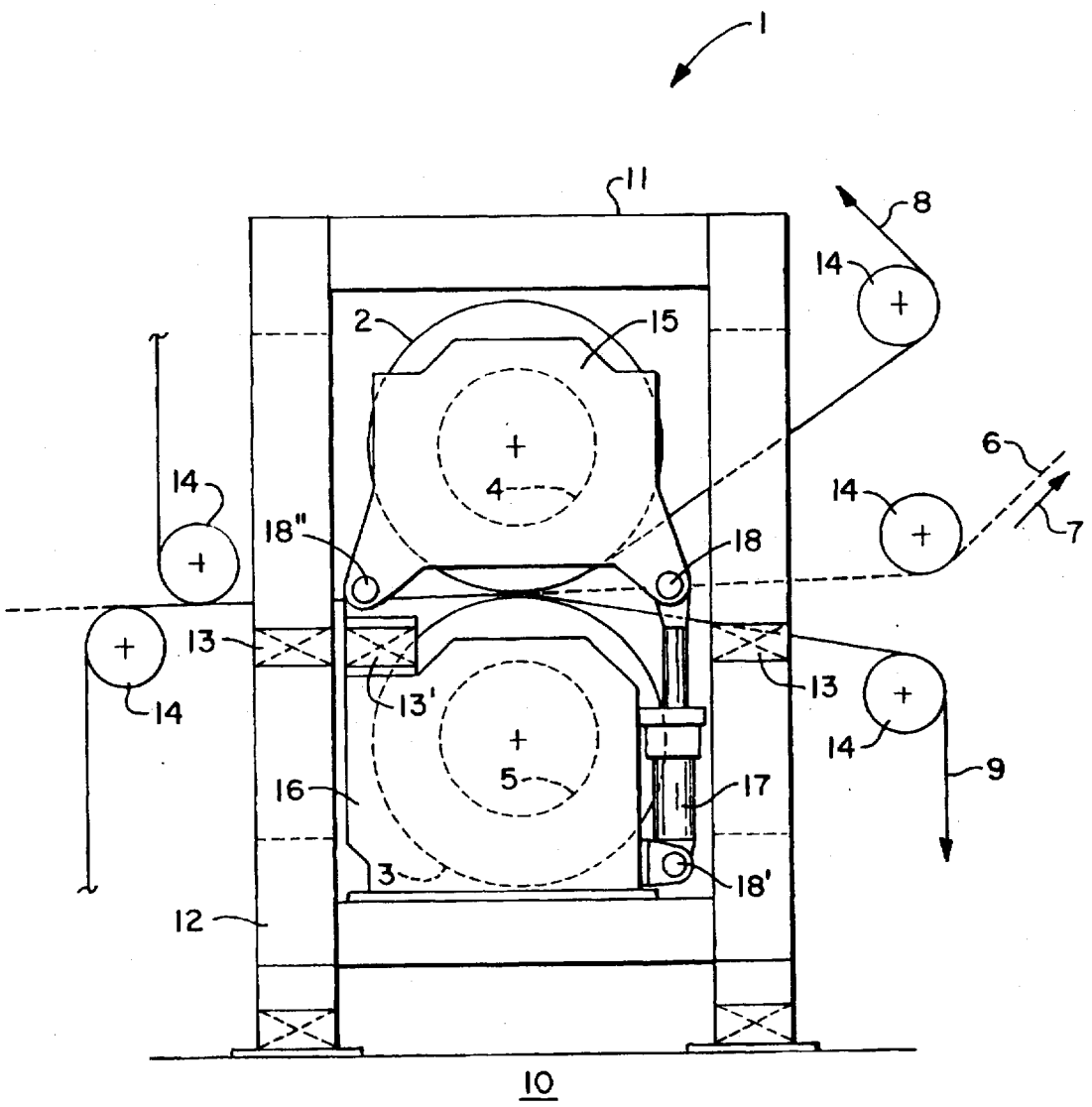
FIG. 1 represents an elevation of an apparatus according to the invention from the idling side.

The embodiment according to FIG. 1 represents a press unit 1 including an upper pressure roller 2 and a lower pressure roller 3, mounted in opposition in bearings 4,5. In the pressure gap between the rollers 2 and 3 a cellulose pulp web 6 is sandwiched between an upper felt web 8 and a lower felt web 9 and thereby dewatered as it is conveyed in the forward direction 7. The press unit 1 is mounted on a foundation 10 and in addition comprises an upper press frame portion 11 and a lower press frame portion 12, these being interconnected by releasable connecting members 13. These connecting members 13 are dismantled for changing the felt and as a rule the felt webs are withdrawn from the idling side. In principle, connecting members 13 are required only on that side from which the felt webs are withdrawn. The cellulose pulp web 6 as well as the felt webs 8,9 are passed around a plurality of the deflecting rollers 14, the felt strips 8,9 taking the form of endless belts. The bearing housing 15 of the upper pressure roller 2 is distinct from the bearing housing 16 of the lower pressure roller 3, except for connection by means of a linkage 18', a hydraulic cylinder 17 and a linkage 18 on one side and by means of a further linkage 18" which may be connected to the bearing housing 16 by way of a releasable connecting member 13'.

The required pressing force may now be adjusted by appropriately extending or retracting the piston of the hydraulic cylinder 17. Thus, the lines of force pass exclusively through the bearing 4 and housing 15, the bearing 5 and housing 16, and the hydraulic cylinder 17 as well as the linkages 18,18', 18" and, where appropriate, the releasable connecting member 13'. The press frame 11, 12 is not subjected to any reaction forces of the pressing forces whatsoever, as a result of which both the press frame 11, 12 as well as the intermediate members 13 which interconnect the two parts thereof need only be dimensioned so as to accommodate the gravitational forces.

Figure 2:
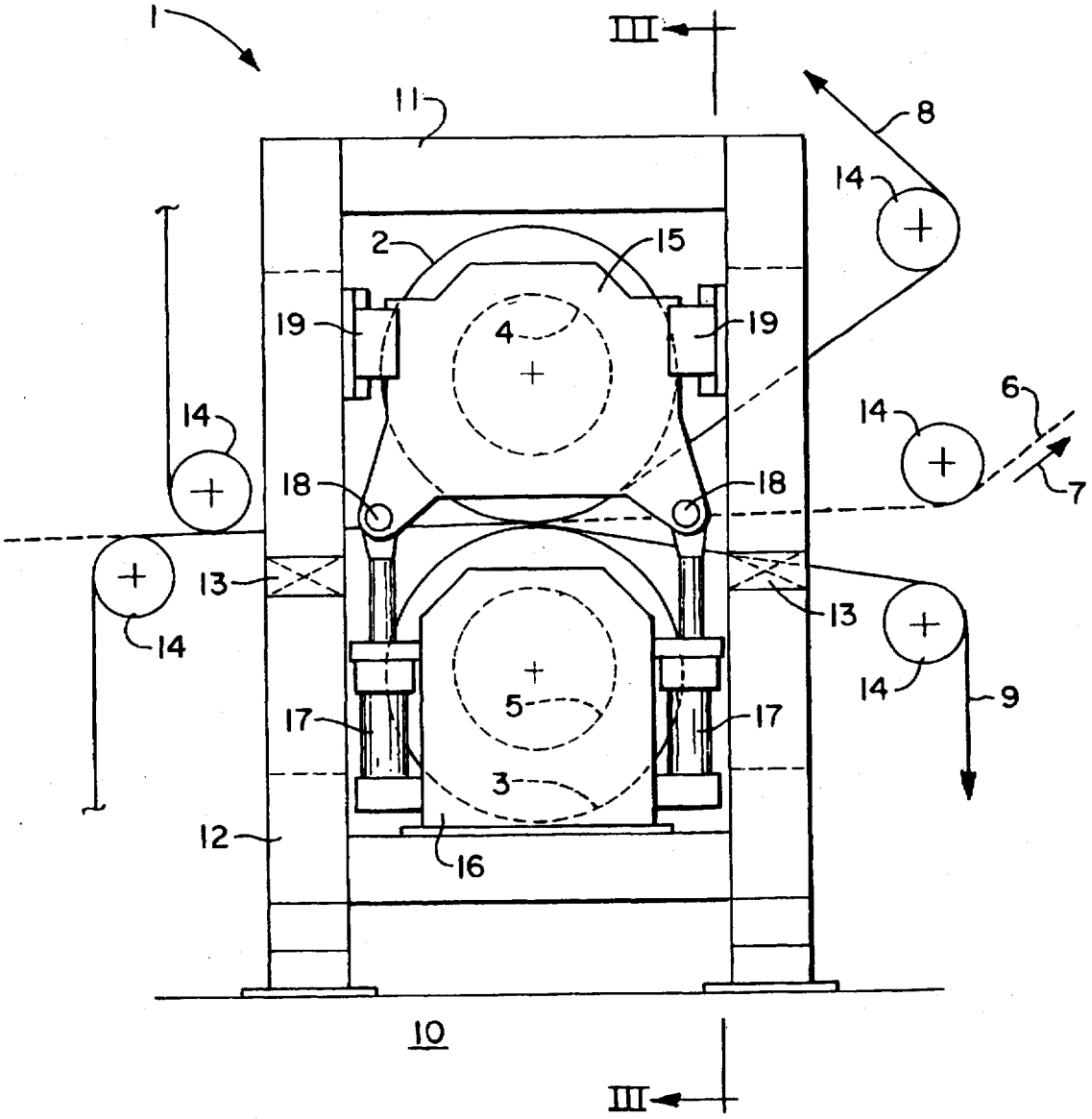
FIG. 2 represents an elevation of a further embodiment of the apparatus from the idling side.
Figure 3:
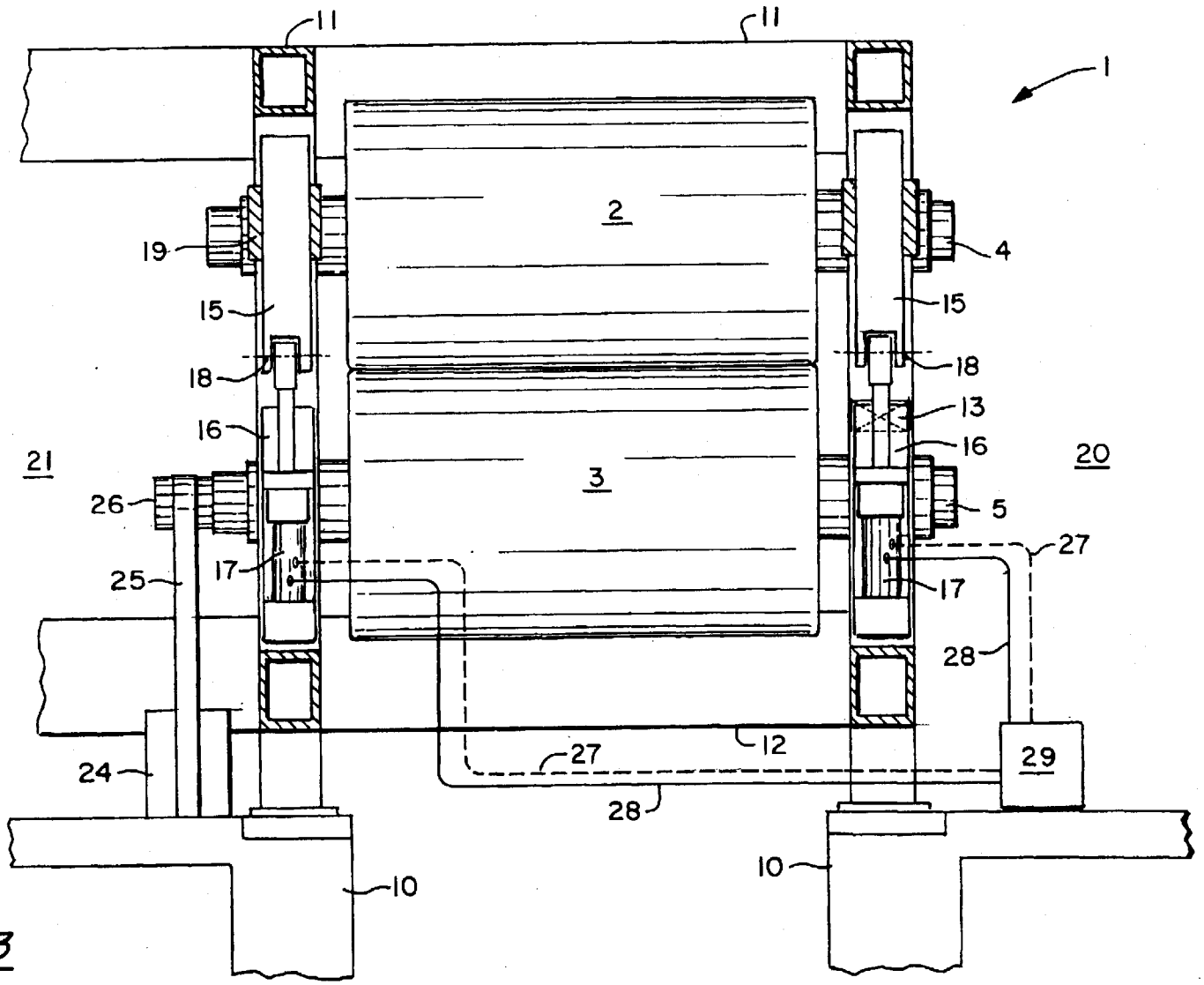
FIG. 3 represents a section according to the plane III—III in FIG. 2.

FIGS. 2 and 3 show a further modification of the invention wherein the reference numbers correspond to those of FIG. 1. Instead of the linkage 18" and the direct connection of the bearing housing 15 to the bearing housing 16 a further pair of hydraulic cylinders is employed in this case (one each on the idling and the driven side respectively). A drive motor 24 and associated drive belt or the like 25 is supported on platform 10 and connected to shaft 26 of lower roller 3. The shaft 26 is supported by housing 16 via bearing 5. The four cylinders permit the attainment of even higher pressure forces. For the accurate guidance of the upper pressure roller 2, lateral guide means 19 are fitted to the upper press frame 11, and may take the form of sliding tracks employed for the bearing housing 15. In this case the intermediate members 13 are provided on the idling side 20 only. They are not strictly necessary for the driven side 21 but may, if needed, depending on the positioning on the factory floor, be provided there as well or even on both sides.

FIG. 3 also shows a portion of a control system including pressure sensor lines 27 from each cylinder (only two shown), hydraulic pressure lines 28 to each cylinder, and a controller logic device 29, whereby the hydraulic pressure applied to each cylinder can be controlled in response to the pressure applied by each cylinder to the web.

Figure 4:
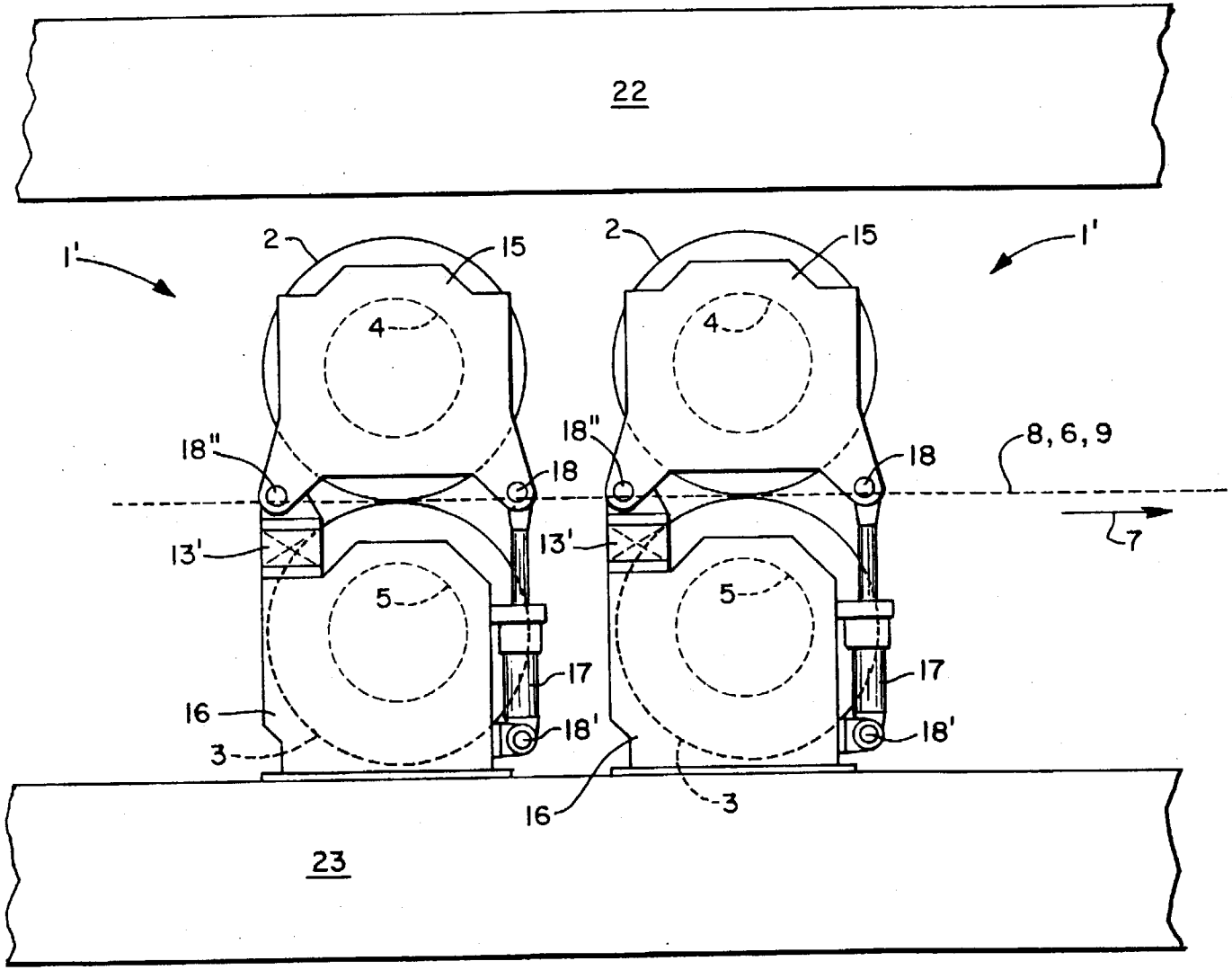
FIG. 4 represents a modification including a plurality of press units according to the invention shown in FIG. 1.
Figure 5:
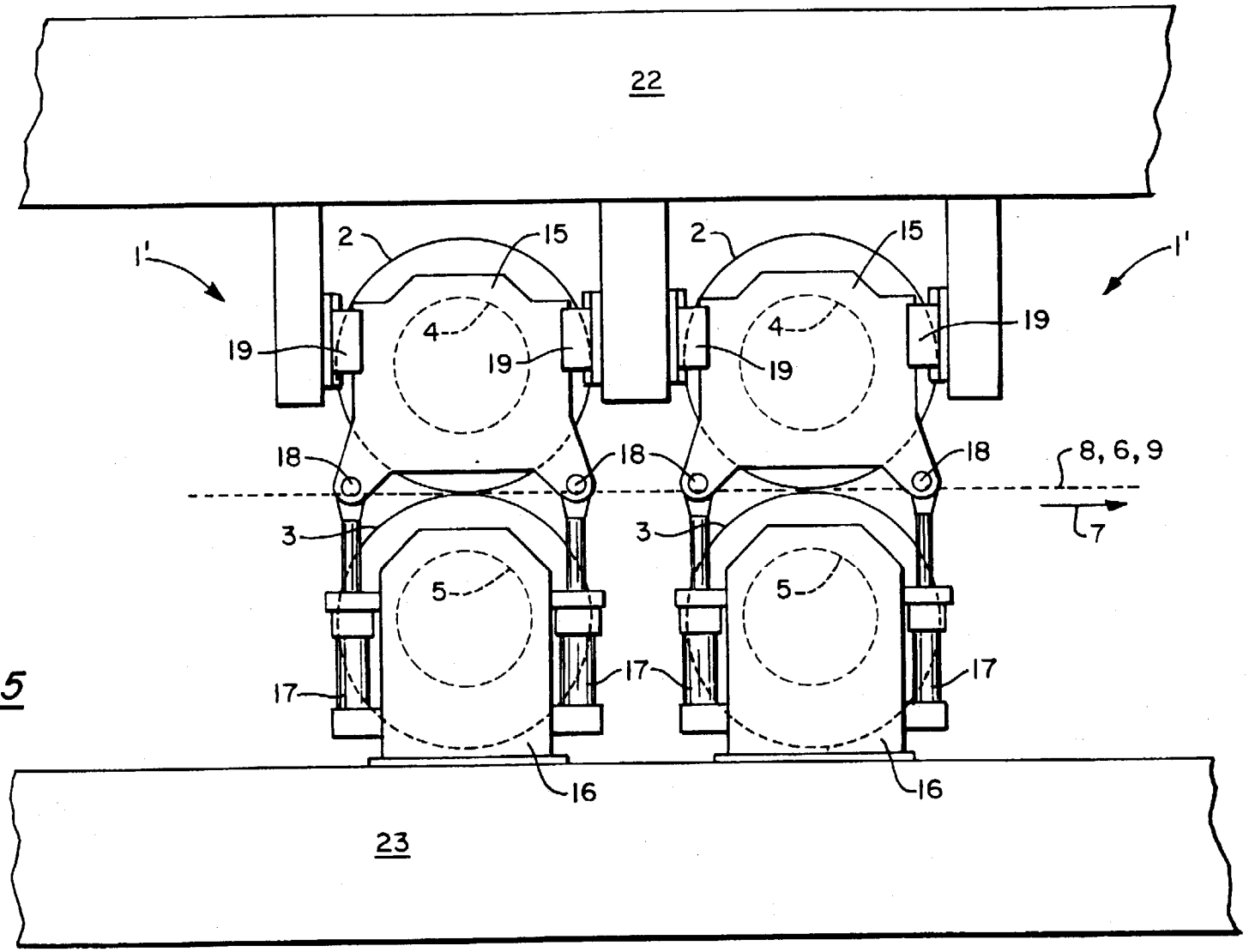
FIG. 5 represents a modification including a plurality of press units according to the invention as shown in FIG. 2.

FIGS. 4 and 5 illustrate modifications of the invention wherein a plurality of press units 1' (in this case for example two press units each are shown) are mounted in a dewatering machine such as for example a double screen press comprising an upper frame or stand 22 and a lower frame or stand 23. The strip 6 to be dewatered passes between the pressure rollers 2,3 and is transported between an upper screen or felt strip 8 and a lower screen or felt strip 9 in the direction 7. Here as well, no forces whatsoever are applied to the stand means 22,23, for which reason, specifically in the case of wide machines, the stand construction 22,23 can be dimensioned very favorable. Besides the application in a double screen press, it is of course also possible to equip the press portion of a paper or cardboard machine with the press unit according to the invention. FIG. 4 illustrates specifically the employment of a press unit according to FIG. 1, and FIG. 5 illustrates the employment of a press unit according to FIG. 2.

The invention is not limited to the examples according to the drawings but, as mentioned above, may in fact be applied particularly advantageously in the pressing regions of a paper or cardboard machine, in those cases as well as the application in wide machines being particularly advantageous.

We claim:

1. Apparatus for dewatering mixtures of fibrous and liquid materials wherein at least one pair of mutually opposite pressure rollers forms a pressure gap through which a continuous web formed of the mixture of fibrous and liquid materials is passed jointly within at least one endless belt and wherein the pressure rollers are supported in mountings disposed in a press frame, at least one pressure roller mounting being removable in such frame, there being provided at least one distance adjustment means for adjusting at least one pressure roller and thereby the magnitude of the pressure gap or the pressure intensity, characterized in that the distance adjustment means is at least one hydraulic cylinder installed solely between and directly to the mountings of the pressure rollers.

2. Apparatus according to claim 1, characterized in that a plurality of hydraulic cylinders are installed between the mountings of the pressure rollers.

3. Apparatus according to claim 1 characterized in that at least one roller has a driven side and an idling side and that there is provided at least one hydraulic cylinder each on both the idling as well as the driven side.

4. Apparatus according to claim 3, characterized in that two hydraulic cylinders each are employed both on the idling side as well as the driven side.

5. Apparatus according to claim 1 characterized in that the hydraulic cylinders jointly with the bearing mounting of a pressure roller, are connected in an articulated manner.

6. Apparatus according to claim 1, characterized in that the mountings each comprise a bearing housing, wherein the hydraulic cylinders are fixedly connected to the bearing housing of one of the pressure rollers.

7. Apparatus according to claim 1, characterized in that the hydraulic cylinders are connected to a means for regulating and/or controlling the pressure forces.

8. Apparatus according to claim 2, characterized in that the hydraulic cylinders are connected to a means for regulating and/or controlling the pressure forces.

9. Apparatus for dewatering a continuously moving web formed of a mixture of fibrous and liquid materials, by passing the web and at least one contiguous endless belt through a pressure gap between a pair of pressure rollers, comprising:

a first pressure roller supported by a first mounting member:

a second pressure roller supported by a distinct second mounting member and spaced a distance from the first pressure roller such that said distance defines said pressure gap for receiving said web and belt; and hydraulic cylinder means connecting the first and second mounting members, for adjusting said distance by moving one of said mounting members toward or away from the other of said mounting members.

10. The apparatus of claim 9, wherein the hydraulic cylinder means includes a plurality of distinct hydraulic cylinders connected between said mounting members at a respective plurality of locations.

11. The apparatus of claim 9, wherein each pressure roller has a rotation axis and each mounting member includes bearing means for supporting a respective roller for rotation about its axis.

12. The apparatus of claim 11, wherein each mounting member includes respective housing means oriented transversely to the roller axis, for supporting the bearing means; and said hydraulic cylinder means is connected directly between the housing means of the first and second members.

13. The apparatus of claim 12, wherein the direct connection between the housing means, is articulated.

14. The apparatus of claim 12, further including drive means supported by at least one of said mounting members and connected respectively to at least one roller for rotationally driving said at least one roller.

15. The apparatus of claim 12, wherein the first, lower roller is supported between a first pair of axially opposed left and right lower housing means, the second, upper roller is supported above the first roller between a second pair of axially opposed left and right upper housing means, and the hydraulic cylinder means consists of four hydraulic cylinders, two of which are connected between the upper and lower left housing means and two of which are connected between the upper and lower right housing means.

16. The apparatus of claim 15, wherein the hydraulic cylinder means includes hydraulic cylinders each of which is connected in fixed relationship to one of the housing means.

17. The apparatus of claim 12, wherein, the first, lower roller is supported between a first pair of axially opposed left and right lower housing means, the second, upper roller is supported above the first roller between a second pair of axially opposed left and right upper housing means, the upper left housing means is connected to the lower left housing means by a stationary pivot joint and by a hydraulic cylinder and piston having one end connected to the lower left housing means and the other end pivotally connected to the upper left housing means;

the upper right housing means is connected to the lower right housing means by a stationary pivot joint and by a hydraulic cylinder and piston having one end connected to the lower right housing means and the other end pivotally connected to the upper right housing means.

18. The apparatus of claim 12, including means for controlling the hydraulic cylinder means in response to measurement of a parameter commensurate with the pressure applied to the web in said gap.

19. The apparatus of claim 9, wherein said pressure rollers mounting members, and hydraulic cylinder means are situated within a press frame, and at least one of the mounting members and associated pressure roller is movable by the hydraulic cylinder means relative to said frame.

20. The apparatus of claim 19, wherein said frame is integrated in the pressing region of a paper or cardboard making machine.

21. The apparatus of claim 19, wherein said frame is integrated in a double screen press machine.

22. The apparatus of claim 15, including means for individually controlling each hydraulic cylinder commensurate with the pressure applied to the web by each cylinder.

23. The apparatus of claim 17, including means for individually controlling each hydraulic cylinder commensurate with the pressure applied to the web by each cylinder.

24. The apparatus of claim 19, wherein the hydraulic cylinder means includes a plurality of distinct hydraulic cylinders connected between said mounting members at a respective plurality of locations.

25. The apparatus of claim 19, wherein each pressure roller has a rotation axis and each mounting member includes a bearing means for supporting a respective roller for rotation about its axis.

26. The apparatus of claim 25, wherein each mounting member includes a respective housing means oriented transversely to the roller axis, for supporting the bearing means; and said hydraulic cylinder means is connected directly between the housing means of the first and second members.

27. The apparatus of claim 26, wherein the first, lower roller is supported between a first pair of axially opposed left and right lower housing means, the second, upper roller is supported above the first roller between a second pair of axially opposed left and right upper housing means, and the hydraulic cylinder means consists of four hydraulic cylinders, two of which are connected between the upper and lower left housing means and two of which are connected between the upper and lower right housing means.

28. The apparatus of claim 27, wherein, the first, lower roller is supported between a first pair of axially opposed left and right lower housing means, the second, upper roller is supported above the first roller between a second pair of axially opposed left and right upper housing means, the upper left housing means is connected to the lower left housing means by a stationary pivot joint and by a hydraulic cylinder and piston having one end connected to the lower left housing means and the other end pivotally connected to the upper left housing means;

the upper right housing means is connected to the lower right housing means by a stationary pivot joint and by a hydraulic cylinder and piston having one end connected to the lower right housing means and the other end pivotally connected to the upper right housing means.

29. The apparatus of claim 26, further including drive means supported by at least one of said mounting members and connected respectively to at least one roller for rotationally driving said at least one roller.

30. The apparatus of claim 19, including means carried on the frame and engaging each movable mounting member for permitting unrestrained vertical movement of each movable mounting member but restricting horizontal movement of each movable mounting member.

31. Apparatus according to claim 1, characterized in that the pair of pressure rollers comprises a movable roller having a mounting which is movable in the frame and a fixedly mounted roller, the movable roller being movably mounted solely to the fixedly mounted roller by linking means for linking the mountings of the movable and fixedly mounted rollers.

32. Apparatus according to claim 1, characterized in that the pair of pressure rollers comprises a movable roller having a mounting which is movable in the frame and a fixedly mounted roller, the movable roller being movably mounted solely to the fixedly mounted roller by a separate set of hydraulic cylinders mounted in the mountings of the movable and fixedly mounted rollers.

33. Apparatus according to claim 9, wherein the first mounting member is movably mounted to the second mounting member by linking means for linking the first and second mounting members.

34. Apparatus according to claim 9, wherein the first mounting member is movably mounted to the second mounting member by a separate set of hydraulic cylinders.

35. Apparatus for dewatering mixtures of fibrous and liquid materials wherein at least one pair of mutually opposite pressure rollers forms a pressure gap through which a continuous web formed of the mixture of fibrous and liquid materials is passed jointly with at least one endless belt and wherein the pressure rollers are supported in mountings disposed in a press frame, the pair of pressure rollers comprising a movable roller having a mounting which is movable in the frame and a fixedly mounted roller, there being provided at least one hydraulic cylinder for moving the movable roller and thereby the magnitude of the pressure gap or the pressure intensity, characterized in that the at least one hydraulic cylinder is installed solely between and directly to the mountings of the pressure rollers and the movable roller is movably mounted solely to the fixedly mounted roller by linking means for linking the mountings of the movable and fixedly mounted rollers or a separate set of hydraulic cylinders.

36. Apparatus for dewatering a continuously moving web formed of a mixture of fibrous and liquid materials, by passing the web and at least one contiguous endless belt through a pressure gap between a pair of pressure rollers, comprising:

a first pressure roller supported by a first mounting member:

a second pressure roller supported by a distinct second mounting member and spaced a distance from the first pressure roller such that said distance defines said pressure gap for receiving said web and belt;

frame means for supporting the pressure rollers and the mounting members, wherein one of the mounting members is fixedly mounted to the frame means;

hydraulic cylinder means connecting the first and second mounting members, for adjusting said distance by moving one of said mounting members toward or away from the other of said mounting members; and linking means for movably linking the first and second mounting members, wherein the first mounting member is movably mounted to the second mounting member solely by the linking means.

37. Apparatus for dewatering a continuously moving web formed of a mixture of fibrous and liquid materials, by passing the web and at least one contiguous endless belt through a pressure gap between a pair of pressure rollers, comprising:

a first pressure roller supported by a first mounting member:

a second pressure roller supported by a distinct second mounting member and spaced a distance from the first pressure roller such that said distance defines said pressure gap for receiving said web and belt;

frame means for supporting the pressure rollers and the mounting members, wherein one of the mounting members is fixedly mounted to the frame means;

first hydraulic cylinder means connecting the first and second mounting members, for adjusting said distance by moving one of said mounting members toward or away from the other of said mounting members; and second hydraulic cylinder means separate from the first hydraulic cylinder means, wherein the first mounting member is movably mounted to the second mounting member solely by the second hydraulic cylinder means.

* * * * *